US006364363B1

(12) United States Patent
Stöber et al.

(10) Patent No.: US 6,364,363 B1
(45) Date of Patent: Apr. 2, 2002

(54) FILM WITH A SECURITY FEATURE, A PROCESS FOR THE PRODUCTION THEREOF AND THE USE THEREOF AS PACKAGING MATERIAL

(75) Inventors: Olaf Stöber, Verden; Christian Kuckertz, Walsrode; Adolf Ahrens, Häuslingen, all of (DE)

(73) Assignee: Wolff Walsrode AG, Walsrode (DE)

( * ) Notice: Subject to any disclaimer, the term of this patent is extended or adjusted under 35 U.S.C. 154(b) by 0 days.

(21) Appl. No.: 09/563,159

(22) Filed: May 1, 2000

(30) Foreign Application Priority Data

May 4, 1999 (DE) ..... 199 20 356

(51) Int. Cl.[7] ..... B42D 15/00

(52) U.S. Cl. ..... 283/72; 283/83; 283/107; 283/108; 283/109; 283/110

(58) Field of Search ..... 283/72, 83, 107, 283/108, 109, 110

(56) References Cited

U.S. PATENT DOCUMENTS

| | | | | | |
|---|---|---|---|---|---|
| 4,536,016 | A | * | 8/1985 | Solomon et al. | 283/111 |
| 4,653,775 | A | * | 3/1987 | Raphael et al. | 283/108 |
| 5,093,184 | A | * | 3/1992 | Edwards | 428/195 |
| 5,310,222 | A | * | 5/1994 | Chatwin et al. | 283/86 |
| 5,380,695 | A | * | 1/1995 | Chiang et al. | 503/227 |
| 5,871,833 | A | * | 2/1999 | Henbo et al. | 428/138 |
| 6,062,604 | A | * | 5/2000 | Taylor et al. | 283/72 |

FOREIGN PATENT DOCUMENTS

| | | |
|---|---|---|
| EP | 317202 | 5/1989 |
| GB | 1095286 | 12/1967 |
| GB | 2245847 | 1/1992 |

* cited by examiner

*Primary Examiner*—Cathy Lam
(74) *Attorney, Agent, or Firm*—Norris McLaughlin & Marcus

(57) ABSTRACT

An optionally laminated film of plastics is described, characterised in that the film is printed on one side with a security ink. A process for the production of such a film and the use thereof as a packaging material are also described.

4 Claims, No Drawings

FILM WITH A SECURITY FEATURE, A PROCESS FOR THE PRODUCTION THEREOF AND THE USE THEREOF AS PACKAGING MATERIAL

The present invention relates to films and is concerned with security features which may be applied to films in order to protect the film or the goods packaged in the film in a simple manner from counterfeiting.

The production and sale of counterfeited goods is a constantly growing problem. Such counterfeited products are frequently packaged in a deceptively similar manner to the authentic products in order to deceive potential purchasers and convince them that they are buying authentic products. This causes various problems. Firstly, the manufacturer of the authentic products loses business. Secondly, the proprietor of rights over the product is cheated of his intellectual property. More importantly still, in many cases it is a fact that the counterfeits are often of poorer quality and thus cause not inconsiderable loss of image to the manufacturer. The poorer quality may furthermore give rise to product liability claims, such that the manufacturer of the authentic product is obliged to prove that the product having caused damage did not originate from said manufacturer. It is accordingly desirable to mark authentic products in such a manner that the consumer is able to recognise authentic products and that, in the event of an incident of damage, it is possible to prove product authenticity.

The most varied kinds of goods, ranging from foodstuffs to consumer goods, such as compact discs and video cassettes, to replacement parts for cars or aircraft, are today traded in outer packaging. This packaging is frequently made from plastics films, paper, paperboard or composites of these materials.

Outer packages have already been used as supports for security features in order to prove the authenticity of the packaged goods. The packaged goods thus need not themselves be provided with the security feature and it is possible, for example, to provide various products from a braned goods manufacturer with the security feature typical of the brand without having to modify the production process for each individual product.

One known form of protecting authenticity is to use so-called security labels. Embossed holograms applied onto the packaging are used, as are security features introduced by means of tear strips. The latter are not always desirable because packaging machinery which is already in use is not always designed for the use of tear strips. Embossed holograms or security labels must be applied in a separate operation, entailing additional effort and thus additional costs.

The object thus arose of incorporating a security feature into a package in a simple manner such that no new, additional operations are required in the production of the package.

The present invention accordingly provides printed films of plastics, optionally combined with another material, characterised in that they are printed on one side with a special security ink. Printing with such an ink constitutes a security feature for the purposes of the stated object.

Films which may be considered are films made from polypropylene, polypropylene copolymer, polypropylene terpolymer, polyester, polyamide, polyethylene, polyethylene copolymer, polyethylene terpolymer, polyvinyl chloride, vinyl chloride copolymer, vinyl chloride terpolymer, polystyrene, polystyrene copolymer, polystyrene terpolymer, polycarbonate, polyketone, polymethyl methacrylate, polymethyl methacrylate copolymers or cellulose film. Biaxially oriented support films of polypropylene, polypropylene copolymer, polypropylene terpolymer, polyester or polyamide are preferably used.

Composite films made from these support films in any desired combination, together with laminar structures of these support films with other materials, such as for example metal, in particular aluminium, or ionomer may also be considered as films. The composites may here be produced by adhesive lamination, coextrusion or vapour deposition or a combination of these processes.

The films may also be laminated with paper as a composite packaging material, wherein lamination may proceed both before and after printing. The paper may also be the print support, which is provided with additional properties by a plastics film.

The present invention also provides a process for the production of an optionally laminated film of the plastic, in which the film is printed with a special security ink and optionally laminated with further films.

According to the invention, printed packaging films are produced in such a manner that a support film is provided in a single operation with both the standard printed image and the security feature. Thus, by using suitable printing members, it is possible to incorporate a security feature within an pre-existing operation.

Printing may be performed both as front and reverse printing. In the case of composite films, the printing ink may also be arranged between the layers.

The support film may have a thickness of between 10 and 300 $\mu$m and a width of between 20 and 2000 mm. The thickness is preferably between 15 and 60 $\mu$m and the width between 600 and 1400 mm.

The support film may be printed in a single colour or in multiple colours. Any printing process usable for films may be considered for this purpose. Printing is in particular performed using typical packaging printing processes, such as offset, screen, flexographic, UV-flexographic or intaglio printing, very particularly by flexographic or intaglio printing.

The security inks used may comprise inks exhibiting the most varied effects.

Thermochromic inks may, for example, be considered which undergo a reversible or irreversible colour change at a certain temperature; daylight fluorescent inks, the fluorescence of which is dependent upon the UV light content of the illumination, such that authenticity may be verified by the technical means of the now common colour copier; luminescent inks, which absorb UV light and emit visible light of a longer wavelength, such that illumination with a UV lamp causes a specified perceived colour, with light being emitted either very rapidly after absorption, a phenomenon known as fluorescence, or lasting for a longer period of time, a phenomenon known as phosphorescence; infra-red inks, which exhibit characteristic absorption behaviour under IR light, such that it is possible to differentiate inks having an identical appearance under daylight; photochromic inks, which undergo a reversible colour change on irradiation with UV light; metameric inks, the colour of which is dependent upon the angle of observation.

Products may be protected from counterfeiting in an advantageous manner using the packaging materials according to the invention. The purpose of the security element is to be able to provide judicial proof of the lack of authenticity of any counterfeit products or alternatively also to enable the consumer, distributor or authorities, such as the customs or police authorities, to recognise the authenticity of a product using simple means.

Printing on one side of the support film may be performed using known printing presses. Depending upon the number of effects desired, one or more print units are filled with security ink and incorporated into the printed image like a conventional ink.

Since, according to the invention, a security element may be incorporated by means of printing processes without additional production stages, it is possible to provide packaging materials with a security element in a particularly simple and economic manner. The present invention accordingly also provides the use of the films according to the invention as a packaging material.

The invention is further illustrated but is not intended to be limited by the following examples in which all parts and percentages are by weight unless otherwise specified.

EXAMPLES

Example 1

A film of biaxially oriented polypropylene of a thickness of 20 μm is printed in eight colours with an ink based on a polyvinyl butyral binder. In-line corona treatment is applied during this process. An element comprising a UV-fluorescent ink is printed in a ninth inking unit.

Example 2

A film of biaxially oriented polypropylene of a thickness of 20 μm is printed in eight colours with an ink based on a polyvinyl butyral binder. In-line corona treatment is applied during this process. An element comprising a UV-fluorescent ink is printed in a ninth inking unit. All printing was performed as reverse-printing. In a second production stage, the printed film is laminated using a solvent-free laminating adhesive to a metallized, biaxially oriented polypropylene film of a thickness of 20 μm.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A film consisting essentially of:

(a) a plastic ply bearing a legend on one of its surfaces, said legend printed with a security ink, wherein said plastic ply is monoaxially or biaxially oriented, and said security ink is based on polyvinyl butyral; and (b) optionally one member selected from the group consisting of polymer film, paper and metal foil.

2. The film of claim 1 wherein said plastic ply is selected from the group consisting of cellulose, (co)poly(vinyl chloride), polyester, (co)plypropylene, polyamide, (co) polyethylene, (co)polystyrene, polycarbonate, polyketone and (co)poly(meth)acrylate.

3. The film of claim 1 wherein said member (b) is a polymer film, said the polymer film being metallized.

4. A packaging material comprising the film of claim 1.

* * * * *